US007293358B2

(12) United States Patent
Wildrick et al.

(10) Patent No.: US 7,293,358 B2
(45) Date of Patent: Nov. 13, 2007

(54) CORE ELEMENT FASTENING AND ASSEMBLY METHOD

(75) Inventors: Donald G. Wildrick, Indianapolis, IN (US); Gregory D. Watkins, Indianapolis, IN (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 192 days.

(21) Appl. No.: 10/975,829

(22) Filed: Oct. 28, 2004

(65) Prior Publication Data

US 2005/0081356 A1 Apr. 21, 2005

Related U.S. Application Data

(62) Division of application No. 10/210,518, filed on Aug. 1, 2002, now Pat. No. 6,865,806.

(51) Int. Cl.
*B21K 3/00* (2006.01)
*B22D 33/04* (2006.01)

(52) U.S. Cl. ..... 29/888.01; 29/432; 29/525.01; 29/798; 264/137; 264/370

(58) Field of Classification Search ..... 29/525.01, 29/888.01, 432, 798
See application file for complete search history.

(56) References Cited

U.S. PATENT DOCUMENTS

| | | | | |
|---|---|---|---|---|
| 2,858,587 | A * | 11/1958 | Leach | 164/137 |
| 4,731,917 | A * | 3/1988 | Krowl | 29/432 |
| 6,435,259 | B1 * | 8/2002 | Baker et al. | 164/137 |
| 6,695,192 | B1 * | 2/2004 | Kwok | 227/8 |
| 6,865,806 | B2 * | 3/2005 | Wildrick et al. | 29/888.01 |

* cited by examiner

*Primary Examiner*—David P. Bryant
*Assistant Examiner*—Sarang Afzali
(74) *Attorney, Agent, or Firm*—Jeffrey P. Calfa; Gerald W. Askew

(57) ABSTRACT

Core sand elements are rapidly and reliably retained in an assembly by driving one or more smooth surface fasteners, such as staples, nails or brads, into the core elements. Such an assembly method comprises positioning at least two core elements in a core assembly, positioning a smooth surface fastener for entry into the at least two core elements, and driving the smooth surface fastener into the two core elements to fasten them in the core assembly. In such a preferred method, the smooth surface fastener comprises a staple with two smooth surface tines connected by a crown and the staple is positioned for entry of one tine into each of two core elements with the crown of the staple spanning the interface between the two core elements.

3 Claims, 4 Drawing Sheets

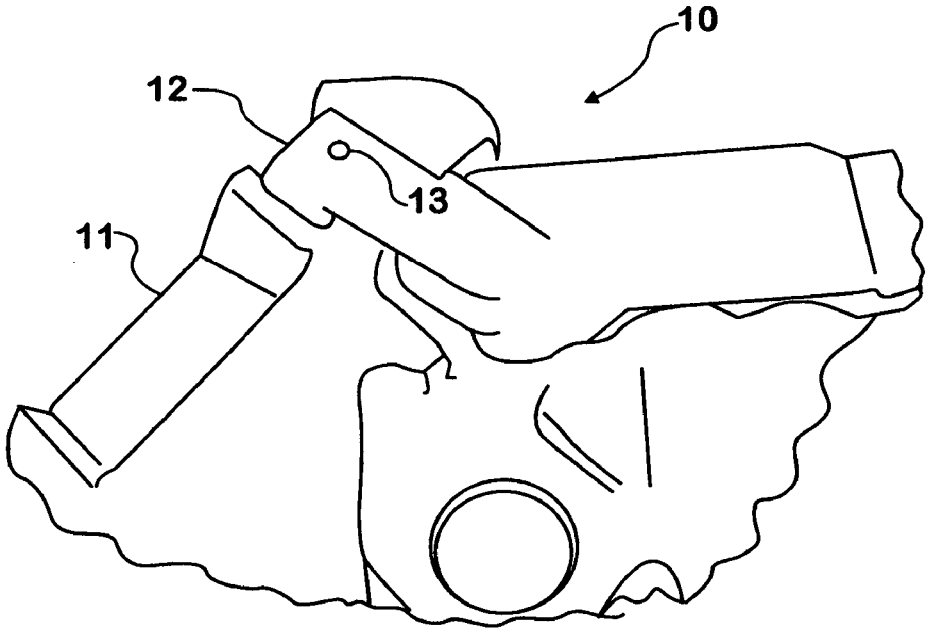
FIG. 1
FIG. 4
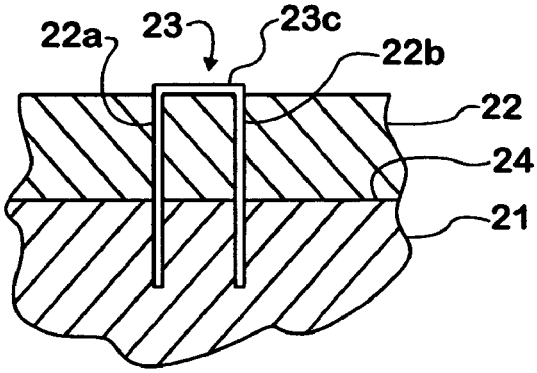
FIG. 2
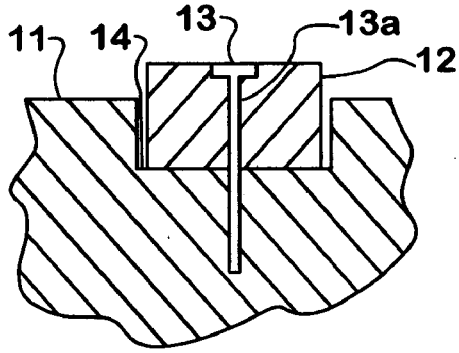

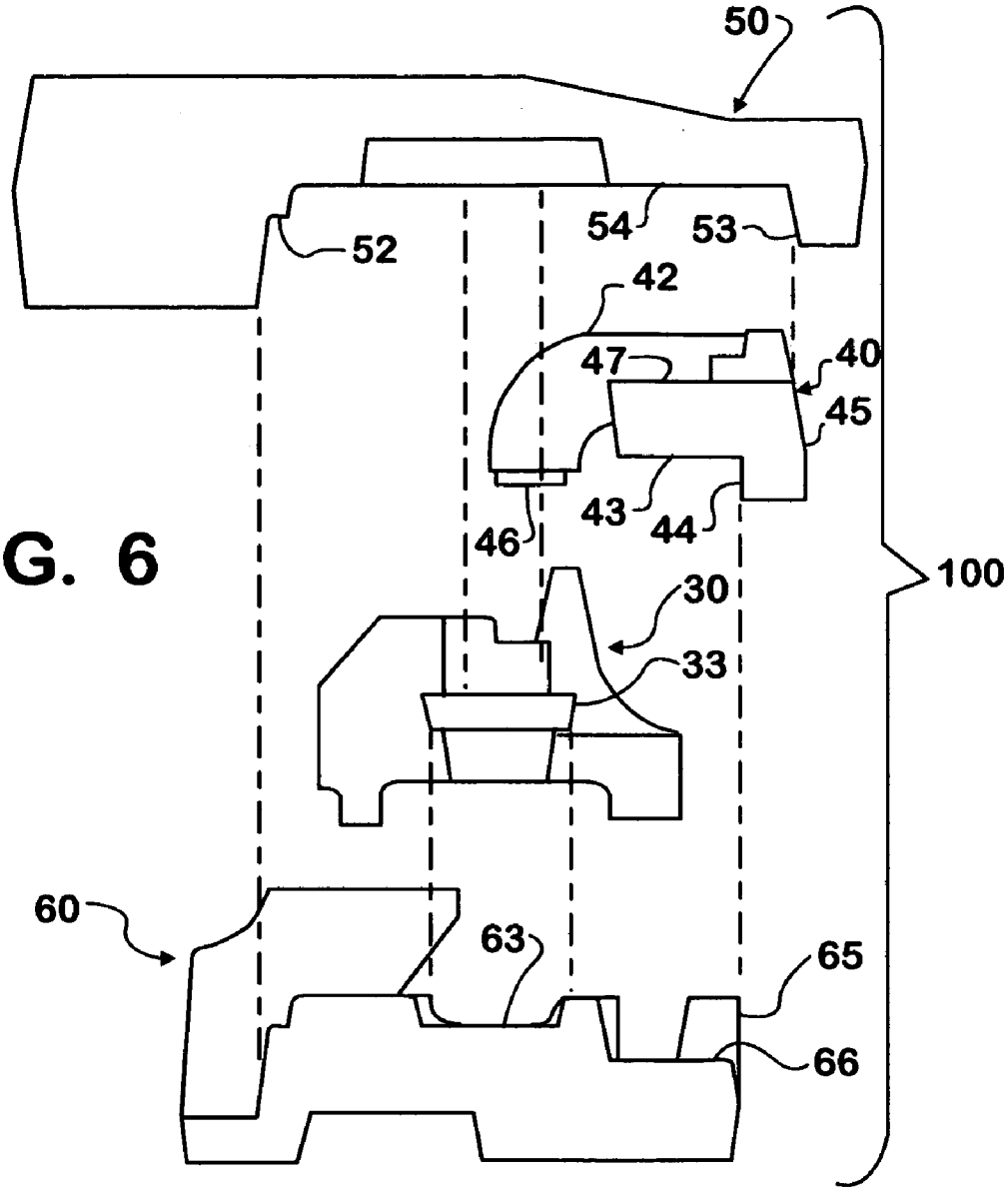
FIG. 6
FIG. 7
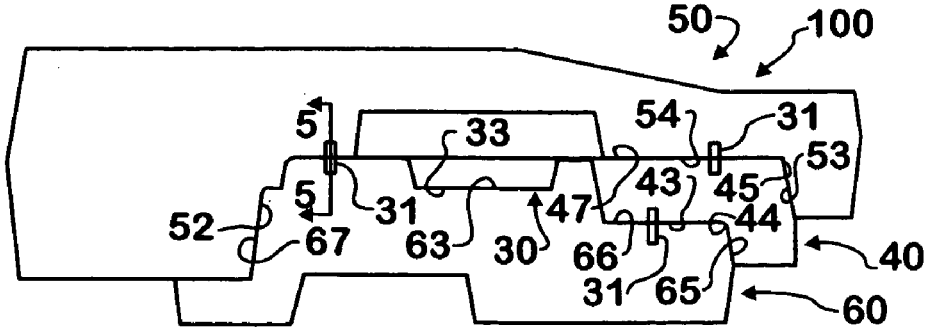

CORE ELEMENT FASTENING AND ASSEMBLY METHOD

This application is a division of U.S. application Ser. No. 10/210,518, filed Aug. 1, 2002, now U.S Pat. No. 6,865,806.

FIELD OF THE INVENTION

This invention relates to methods for casting parts for internal combustion engines, and more particularly to methods of assembling and fastening core elements of core assemblies.

BACKGROUND OF THE INVENTION

The manufacture of castings for internal combustion engines poses difficult manufacturing problems. For example, the cylinder head of an internal combustion engine, whether for a spark-driven gasoline internal combustion engine or a compression-ignition diesel engine, is a complex article of manufacture with many requirements. A cylinder head generally closes the engine cylinders and contains the many fuel explosions that drive the internal combustion engine, provides separate passageways for the air intake to the cylinders for the engine exhaust, carries the multiplicity of valves needed to control the air intake and engine exhaust, provides a separate passageway for coolant to remove heat from the cylinder head, and can provide separate passageways for fuel injectors and the means to operate fuel injectors.

The walls forming the complex passageways and cavities of a cylinder head must withstand the extreme internal pressures, temperatures and temperature variations generated by the operation of an internal combustion engine, and must be particularly strong in compression-ignition diesel engines. On the other hand, it is desirable that the internal walls of the cylinder head, particularly those walls between coolant passageways and the cylinder closures, permit the effective transfer of heat from the cylinder head.

It is also important that all castings for internal combustion engines include minimal metal to reduce their weight and cost. The countervailing requirements of reliable internal combustion engine parts makes casting such parts difficult. Furthermore, these complex parts are manufactured by the thousands and assembled into vehicles that must operate reliably under a variety of conditions. Consequently, the casting of internal combustion engine parts has been the subject of the developmental efforts of engine and automobile manufacturers throughout the world for years.

Cylinder heads are most generally manufactured by casting them from iron alloys. The casting of the cylinder head portion that closes the cylinders, carries the intake and exhaust valves and fuel injectors and provides the passageways for the air intake, exhaust and coolant requires a mold carrying a plurality of core elements. To provide effective cooling of the cylinder head and effective air intake and exhaust from the cylinders of the internal combustion engine, the passageways for the air intake and exhaust are best interlaced with the coolant passageways within the cylinder head portion. The cavities for coolant, air intake and exhaust must, of course, be formed by core elements within the mold that can be removed when the casting metal solidifies.

Such core elements are formed from a mixture of core sand and a curable resin, which, when cured, retains the shape imposed on it prior to curing, and after a casting solidifies, the core sand and resin residue are removed from the casting.

As a result of recent developments, core assemblies are provided by a plurality of core elements that have interengaging surfaces to locate the plural core elements in the core assembly. For example, head core assemblies can be formed by the assembly of a one-piece coolant jacket core, a one-piece exhaust core, and a one-piece air intake core that interengage during their assembly; however, to maintain such an assembly together as a unit during post assembly handling and casting, the core elements must be fastened together. Because of the high rate of manufacture of internal combustion engines and the stringent requirements for their reliability, such fastening methods must be both rapidly effected and reliable. In the past, adhesive and/or screws have been used to fasten core elements together to maintain the integrity of the core assembly during its handling and during pouring of the casting.

The use of an adhesive requires an adhesive that can be easily spread on the core elements, that will set within the shortest possible time; that will hold the core elements together as one piece and maintain their position during the casting process, and that may be removed from the casting after the casting metal solidifies. This method results in substantial costs and opportunities for unreliable castings because of a potentially unreliable interface between the core elements. The adhesive materials may separate or otherwise become degraded in storage. It is also necessary that workmen apply the adhesive correctly so that the adhesive reliably maintains the core elements together during casting and is not spread onto an exposed casting surface. Furthermore, this method requires time for applying the adhesive, assembling the core elements together and allowing the adhesive to set before the core elements can be used for casting, and it introduces into the mold an unnecessary foreign element in the form of an adhesive that may evolve gas that may become trapped in the solidified casting and cause areas of possible failure.

Because of the difficulties of using adhesive to fasten core elements together, screws have been used to fasten the core elements of core assemblies together. Although the use of screws to fasten core elements together provides a more predicable assembly of the core elements than adhesive, the use of screws requires the installation of accurately sized pins in the mold-form for the core to provide accurately sized holes in the core to accept the screws. Such pins in the mold-form became eroded by the abrasive core sand and bent in use, resulting in holes in the core that are too small or that cannot accept screws from an automatic installation station. As a result, screws frequently fail to properly engage the core sand core elements and to provide holding engagement of the core sand element as a result of core sand stripping during their installation.

BRIEF SUMMARY OF THE INVENTION

The invention provides a-rapid and reliable method of fastening assembled core elements together without the use of the adhesives or screws. In the invention, core sand elements are retained in an assembly by driving one or more smooth surface fasteners into the core elements. A method of the invention comprises positioning at least two core elements in a core assembly, positioning a smooth surface fastener for entry into the at least two core elements, and driving the smooth surface fastener into the two core elements to fasten them in the core assembly. In a preferred method of the invention, the smooth surface fastener comprises a staple with two smooth surface tines connected by a crown and the staple is positioned for entry of one tine into each of two core elements with the crown of the staple spanning the interface between the two core elements. In another preferred method of the invention, a plurality of core elements are assembled into a core assembly, and a fastening fixture comprising a plurality of staple or nail guns is positioned in the core assembly with the plurality of staple or nail guns located for insertion of staples or nails into the core elements, and a plurality of air-driven staples or nails are simultaneously driven into the core elements of the core assembly to fasten the core assembly together. The smooth surface fasteners may be nails, brads or staples, and the method may include driving such smooth surface fasteners into the assembled core elements with a staple or nail gun, which is preferably driven by factory-compressed air.

Other steps, features and advantages of the invention will be apparent to those skilled in the art from the drawings and more detailed description of the best mode of the invention that follows.

BRIEF DESCRIPTION OF THE DRAWINGS

FIG. 1 is a partial perspective view of two core elements fastened together through the use of the invention;

FIG. 2 is a partial cross-sectional view of two core elements fastened together using a nail in the invention;

FIG. 4 is a partial cross-sectional view showing two core elements fastened together through the use of a staple in the invention;

FIG. 6 is an exploded side view of the core elements of a core assembly for an internal combustion engine head core assembly; and FIG. 7 is an end view of the head core assembly of FIG. 6 fastened together with the invention.

DETAILED DESCRIPTION OF THE BEST KNOWN MODE OF THE INVENTION

Figure 3:
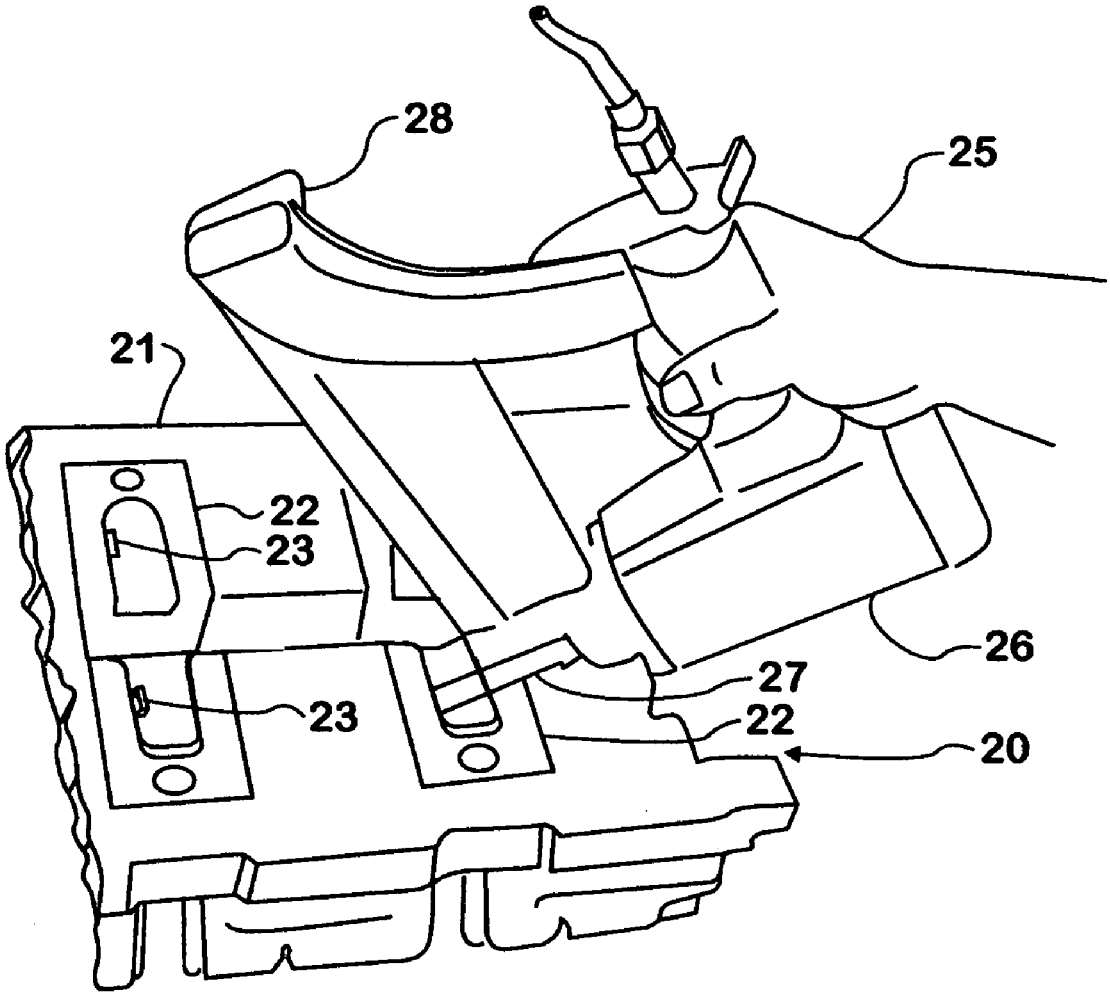
FIG. 3 is a partial perspective view illustrating a method of fastening core elements together with staples and a staple gun.

FIG. 1 illustrates an assembly 10 of the invention comprising core elements 11, 12, both of which are formed by core sand and a cured resin, such as the resin used in the phenolic urethane cold box process that is well-known in the art, typically comprising a phenolic resin and an isocyanide resin, mixed in at the ratio of 55 parts to 45 parts, respectively, and cured with a triethylamine catalyst after formation of the core elements 11, 12. Core element 11 comprises a front end core, and core element 12, which is substantially smaller than core element 11, comprises a water crossover core. In accordance with the invention, the core elements 11, 12 are fastened together by a nail 13, which is driven through the small core element 12 into the larger core 11.

FIG. 2 is a partial cross-sectional view of the assembly 10, taken at a plane through the center of the nail 13. As illustrated in FIG. 2, the shank 13*a* of nail 13 has sufficient length to pass completely through the core element 12, the interface 14 between core elements 11 and 12 and well into the body of the core element 11. In this method, nail 13 has a length of about 2 inches and penetrates into core element 11 a distance of about ½ inch to ¾ inch. Because this core assembly 10 needs to be fastened together only until it is placed in a larger containing core assembly, only one nail is necessary to fasten the water crossover core 12 to the front end core 11. The smooth-sided shank 13*a* frictionally engages the surfaces it forms in core elements 11, 12 to retain their engagement at the interface 14 and prevent the lateral movement of core elements 11, 12 with respect to each other. Furthermore, when the nail is driven into the core assembly 10 with a nail gun, it is believed that the adhesive resin, which retains the nails to be driven in a stick assembly for insertion into the nail gun and adheres to the nail as it is driven, is melted by the friction between the moving nail and the core sand and solidifies to assist in retention of the nail 13 and core elements 11 and 12 in the assembly 10.

FIG. 3 illustrates a partial perspective view of the preferred fastening method of the invention using staples and a staple gun to drive the staples into the assembled core elements. As well known in the art, a staple has two smooth surface tines interconnected by a crown. As illustrated in FIG. 3, core assembly 20 comprises a crankcase core 21 formed from core sand and a plurality of gating core inserts 22 formed from core sand which are being fastened together using a plurality of staples 23 as smooth-sided fasteners. In the assembly method, a workman uses his hand 25 to position the staple gun 26 so the barrel 27 of the staple gun 26 is held against one of the core inserts 22 in a position to drive the staple 23 through the core insert 22 and into the frame core 21 to retain the core insert in the frame core. The staple gun preferably contains a cartridge 28 containing a multiplicity of staples 23 that are retained in a "stick" by an adhesive resin and automatically fed to the barrel 27 to be driven by an air-actuated cylinder within the staple gun 26, which is triggered by the workman's hand.

FIG. 4 illustrates the fastening of core elements 21, 22 together using staple 23 as illustrated in FIG. 3. The tines 23*a* and 23*b* of the staple 23 have sufficient length to pass through gating core element 22, the interface 24 between core elements 21 and 22, and well into the core element 28; however, the staple driver 26 is adjusted so the crown 23*c* of the staple has no significant penetration into the core element 22 to avoid damage to core element 22. As with the nail illustrated in FIGS. 1 and 2, the smooth sides of the tines 23*a* and 23*b* of the staple 23 frictionally engage core elements 21 and 22, maintaining their contact at their interface 24 and preventing the lateral movements of core elements 21, 22 with respect to each other. It is believed that the adhesive resin that maintains a plurality of staples in a stick for insertion into the staple gun 26 is melted by the friction of insertion and solidified to assist in retention of the staple 23 and core elements 21 and 22 in the core assembly.

Figure 5:
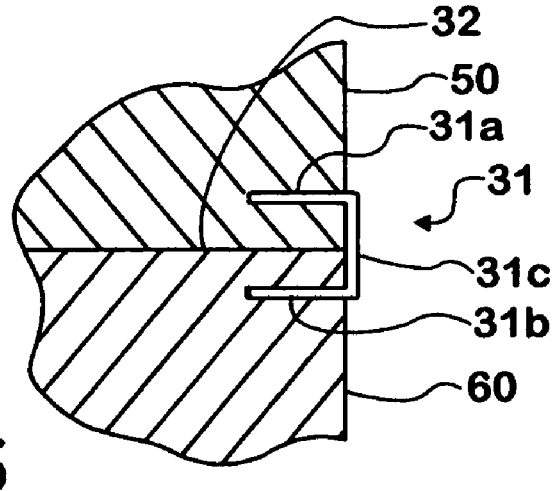
FIG. 5 is a partial cross-sectional view illustrating a preferred use of a staple in the invention.

FIG. 5 is a partial cross-sectional view of a preferred use of a staple fastener 31 to fasten two core elements (e.g., 50, 60) together in a core assembly, as further set forth in the description of FIGS. 6 and 7 below. As illustrated in FIG. 5, in a preferred use of staples in the invention, one tine 31 a of staple 31 penetrates one core element (e.g., 50) and the second tine 31*b* of the staple penetrates a second core element (e.g., 60) with the crown 31*c* of the staple 31 spanning the interface 32 between the two core elements. In the preferred method of the invention, the penetration of the two tines 31*a* and 31*b* and the crown 31*c* retain the two core elements (e.g., 50, 60) in an assembly. Where the staples are driven into the core elements by a staple gun, the staple gun is adjusting so the crown 31*c* of the staple has no significant impact on the core elements. FIGS. 6 and 7 further illustrate the preferred method of the invention.

FIG. 6 is an exploded view of a head core assembly, illustrating, as an example, head core elements that can be fastened together in a head core assembly with the invention.

In casting a cylinder head with a method of the invention, for example, a one-piece coolant jacket core 30 having a plurality of core supporting and positioning surfaces and a frame core 60 having a plurality of core supporting and positioning surfaces may be provided, and the one-piece coolant jacket core 30 may be supported and positioned on the frame core 60 by engaging corresponding core supporting and positioning surfaces of the coolant jacket core and the frame core. As shown in FIG. 6, the coolant jacket core 30 may be lowered into the frame core 60 with a supporting and positioning surface, e.g., 33, of the one-piece coolant jacket core engaged with supporting and positioning surface, e.g., 63, of the frame core 60. A one-piece exhaust core 40 having a plurality of exhaust passageway-forming portions, such as 42, with a plurality of core supporting portions, such as 46, may be inserted into the assembled frame core 60 and coolant jacket core 30 by extending the elongated exhaust passage-forming portions, e.g., 42, which project transversely outwardly from the exhaust core, through openings (not shown) in the coolant jacket core 30, and the one-piece exhaust core 40 may be supported and positioned in the assembly by engaging the plurality of corresponding core supporting and engaging surfaces of the exhaust core, e.g., 43, 44, and the frame core, e.g., 65, 66. An intake core 50, having a plurality of core supporting and positioning surfaces adapted to engage the frame core 60, the coolant jacket core 30 and the exhaust core 40 completes a core assembly 100 with the core elements positioned together for formation of a head core assembly. The intake core 50 provides a plurality of air intake passage-forming portions, e.g., 54, that extend transversely outwardly from its frame, and the intake core 50 is located on the assembled frame core 60, coolant jacket core 30 and exhaust core 40 by a plurality of core supporting and positioning surfaces, e.g., 52, 53, 54, engaging the corresponding core supporting and positioning surfaces of the frame core, e.g., 67, coolant jacket core, e.g., 33, and exhaust core, e.g., 45, 47, locking the core elements, by their engagement, into an integral unit. Core assemblies with interlocking core elements are further described in U.S. Pat. No. 5,119,881. With the invention, the core elements 30, 40, 50, 60 are fastened together in the core assembly 100 by a plurality of staple 31, driven as indicated in FIG. 5, into core elements 50 and 60, 40 and 60, and 40 and 50, respectively.

Figure 8:
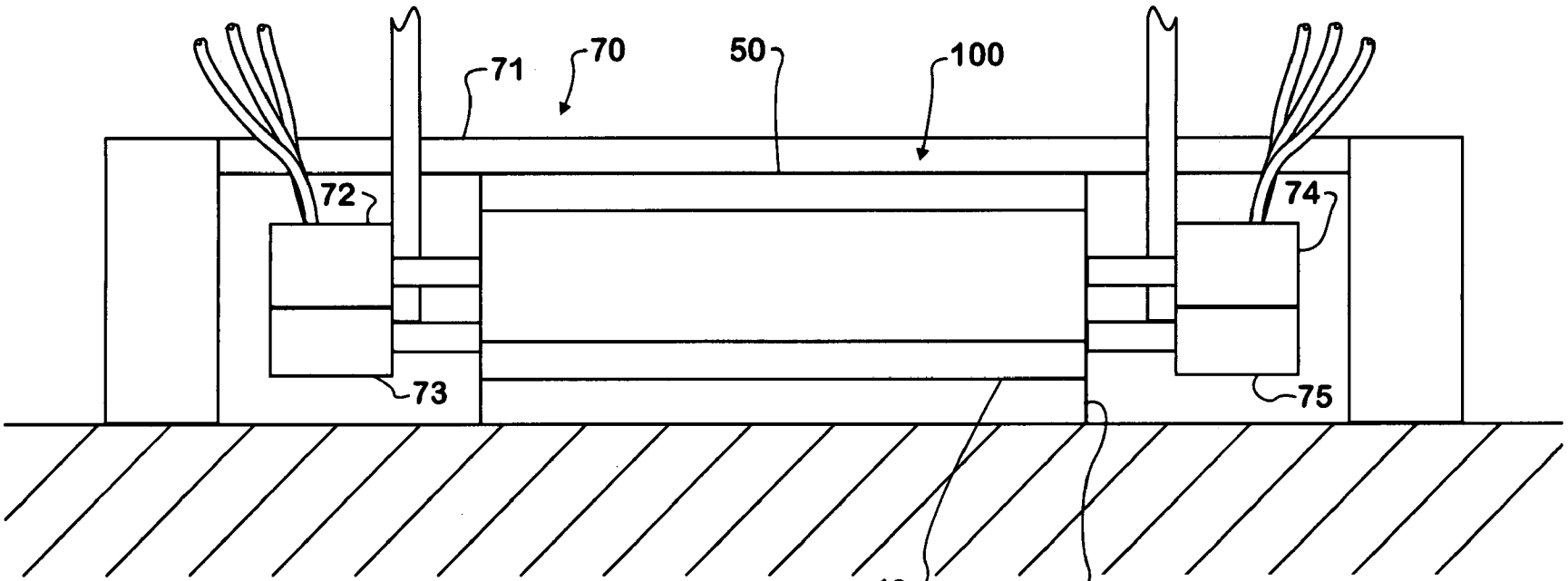
FIG. 8 is a side view of the assembled head core assembly of FIG. 7 to illustrate a fastening tool for fastening the head core assembly elements of FIG. 6 together, as illustrated in FIG. 7.

In production, the core elements 30, 40, 50, 60 may be fastened together, by providing a fastening fixture 70 comprising a frame 71 placed adjacent the core assembly 100. The frame will position a plurality of air-driven staple guns 72, 73, 74, 75 to simultaneously drive the plurality of staples 31 horizontally into the opposite ends of core elements (several staple guns are not visible in FIG. 8). As indicated, the staple guns 72, 73, 74, 75 are positioned so that staples 31 are simultaneously driven into the opposite ends of the assembled core elements 100 with one tine in core element 50 and one tine in core element 60, with one tine in core element 40 and two in core element 50, and with one tine in core element 40 and one tine in core element 60, with their crowns spanning the interfaces between core elements 50 and 60, 40 and 50, and 40 and 60, respectively, to hold the core assembly 100 together.

Pneumatically driven guns are the preferred means for inserting the smooth surface fasteners into the core elements, and staple guns, like staples, are preferred over nail guns because the nail guns are more prone to jamming. Staple and nail guns can be obtained from SENCO PRODUCTS, INC., of Cincinnati, Ohio, with preferred models being the Senco Model SNS 40, with countersink adjustment for staples, and Senco Model SNS 40, with countersink adjustment for nails.

The invention provides not only greater reliability and reduced assembly times, but also substantial material savings. In one application of the invention, the use of a staple cost 0.4 cents ($0.004) permitted the replacement of a core interconnecting rod costing 30 cents ($0.30). In other applications, the invention permitted staples costing 0.4 cents ($0.004) to replace screws costing 1.6 cents ($0.016). While these differences in cost may seem small, they become substantial in the manufacture of internal combustion engines in tens of thousands per year.

In the use of the invention illustrated by FIG. 3, the gate cores 22 are attached to the crank case core with two 7/16-inch crown staples in each gate core element, and in the operation of the invention illustrated in FIG. 1, the water cross-over core component 12 can be attached to the front end core 11 with one 2-inch finishing nail. It is believed that the smooth surface fastener should be long enough to penetrate a core element about one-half inch and preferably about ¾ inch or more for satisfactory fastening.

While we have illustrated and described the best mode currently known for practicing our invention, other embodiments and methods of practicing the invention within the scope of the following claims will be apparent to those skilled in the art.

We claim:

1. A method comprising the steps of:

assembling at least two core sand elements into a core assembly for casting an internal combustion engine part;

providing a fastening fixture comprising a plurality of staple guns oriented for insertion of a plurality of staples into the at least two core sand elements of the core assembly;

positioning the fastening fixture adjacent the core assembly with each of the plurality of staple guns located for insertion of a staple into the at least two core sand elements; and driving with rectilinear motion a plurality of staples into the at least two core sand elements to span an interface between the at least two core sand elements without clenching the tines of the staples to fasten the core assembly together.

2. A method of fastening a core assembly together in casting parts for an internal combustion engine comprising:

assembling a plurality of core elements into a core assembly for casting an internal combustion engine part;

providing a fastening fixture comprising a plurality of staple guns oriented for insertion of a plurality of staples Into the core elements of the core assembly;

positioning the fastening fixture adjacent the core assembly with each of the plurality of staple guns located for insertion of a staple into two core elements; and simultaneously driving a plurality of staples into the core elements of the core assembly without clenching the tines of the staples to fasten the core assembly together;

wherein at least one of the plurality of staples is oriented for insertion of a staple with only one tine in a first one of the two adjacent core elements, with the staple crown extending between the at least two adjacent core elements.

3. The Improvement of claim 2, wherein the staple is driven with rectilinear motion through the plurality of core elements by an air-driven gun.

* * * * *